US008556247B2

(12) United States Patent
Caporusso

(10) Patent No.: US 8,556,247 B2
(45) Date of Patent: Oct. 15, 2013

(54) VISE PROVIDED WITH A MOVABLE JAW DEVICE HAVING SEPARATED APPROACHING AND CLAMPING STEPS IN A PIPE BENDING MACHINE DIE

(75) Inventor: Alessandro Caporusso, Piedimonte San Germano (IT)

(73) Assignee: CML International S.p.A., Piedimonte San Germano (FR) (IT)

( * ) Notice: Subject to any disclaimer, the term of this patent is extended or adjusted under 35 U.S.C. 154(b) by 403 days.

(21) Appl. No.: 12/936,216

(22) PCT Filed: Apr. 3, 2009

(86) PCT No.: PCT/IT2009/000138

§ 371 (c)(1), (2), (4) Date: Nov. 9, 2010

(87) PCT Pub. No.: WO2009/122457

PCT Pub. Date: Oct. 8, 2009

(65) Prior Publication Data

US 2011/0042877 A1 Feb. 24, 2011

(30) Foreign Application Priority Data

Apr. 4, 2008 (IT) ..... RM2008A0180

(51) Int. Cl.
*B25B 11/00* (2006.01)

(52) U.S. Cl.
USPC ..... 269/87.1; 269/32; 269/24

(58) Field of Classification Search
USPC ..... 269/87, 1, 32, 24, 27, 28, 228, 229, 269/231, 68
See application file for complete search history.

(56) References Cited

U.S. PATENT DOCUMENTS

| | | | | |
|---|---|---|---|---|
| 3,436,071 | A * | 4/1969 | Petruccelli | 269/20 |
| 4,901,990 | A * | 2/1990 | Frechette | 269/25 |
| 6,056,281 | A * | 5/2000 | Moilanen et al. | 269/32 |
| 6,886,820 | B1 * | 5/2005 | Hausler, III | 269/24 |
| 2011/0042877 | A1 * | 2/2011 | Caporusso | 269/87.1 |

FOREIGN PATENT DOCUMENTS

| | | |
|---|---|---|
| EP | 0 742 080 A1 | 11/1996 |
| EP | 1 623 772 A2 | 2/2006 |

OTHER PUBLICATIONS

International Search Report, dated Oct. 14, 2009, from corresponding PCT application.

* cited by examiner

*Primary Examiner* — Lee D Wilson
(74) *Attorney, Agent, or Firm* — Young & Thompson

(57) ABSTRACT

A vise provided with a movable jaw device having separated approaching and clamping steps in a bending machine die, the vise (4) having a fixed jaw portion (7) and a movable jaw device (10) including a body (6) having two abreast supporting walls (8, 9), on an external side of one of which an operation mechanism (20) of the movable jaw is mounted, and upper edges (31, 32) of the supporting walls acts as cams for opposite spindles (29, 30) laterally projecting from one hydraulic cylinder (28) that is swing mounted on the movable jaw (11). The upper edges (31, 32) have two respective notches (33, 34) designed to receive the projecting spindles in such a way that the extension of the rod (27) of the hydraulic cylinder (28), being locked in position by its projecting spindles.

5 Claims, 8 Drawing Sheets

VISE PROVIDED WITH A MOVABLE JAW DEVICE HAVING SEPARATED APPROACHING AND CLAMPING STEPS IN A PIPE BENDING MACHINE DIE

TECHNICAL FIELD

The present invention relates to a vise provided with a movable jaw device having separated approaching and clamping steps in a bending machine die.

BACKGROUND ART

The Applicant is the owner of the European patent No. EP 1 623 772 granted on 26 Mar. 2008, that discloses a vise for clamping an elongated workpiece to be bent on a bending machine die. The vise comprises a jaw being rotatable about a pivoting end so that the jaw is approachable to and removable from a circumferential groove of the die in order to surround, from opposite parts, an elongated workpiece. The movable jaw is rotated by an operation mechanism comprising a first hydraulic cylinder that is provided with a rack being connected to its cylinder rod, and a pinion being keyed to the movable jaw and meshing with the rack. Once the rotatable jaw has approached the elongated workpiece to be bent, a retaining device being operated by a second hydraulic cylinder is able to grip a jaw retaining end opposite to the jaw pivoting end in order to clamp the elongated workpiece to be bent in a closed position.

In the above cited European patent there are two separated steps, the one being an approaching step to, the other being a clamping step of an elongated workpiece to be bent in a pipe bending machine. This allows an elongated workpiece to be retained with a high reliability in bending operation. However, as the operation mechanism is fixed on a die side and the retaining device is fixed on the opposite die side, the vise is cumbersome especially in its part that is situated in the lower die side. This prevents some design choices to be made, and generally a pipe bending machine increases in size.

The present invention aims to overcome the drawback above mentioned.

In particular, a main object of the invention is to allow a die to be made having a gripping device of the workpiece to be bent, gripping device that operates with a jaw having two separated approaching and clamping steps, without requiring parts of the gripping device of the workpiece to be bent on both sides of the die.

DISCLOSURE OF THE INVENTION

The object is achieved by an invention that gives a vise provided with a movable jaw device having separated approaching and clamping steps in a bending machine die, wherein the movable jaw device comprises a body being fixed on the die and having two abreast supporting walls, on an external side of one of which said operation mechanism of the movable jaw is mounted, and upper edges of the supporting walls act as cams for opposite spindles laterally projecting like trunnions from said second hydraulic cylinder that is swing mounted by means of a connection of its cylinder rod with a small shaft being transversally pivoted in the movable jaw in a rear end thereof opposite to the front gripping end thereof, the upper edges of the supporting walls having two respective notches designed to receive the projecting spindles of said second hydraulic cylinder in such a way that the extension of the rod of the second hydraulic cylinder, being locked in position by its projecting spindles in the respective notches, keeps the movable jaw in closed position.

BRIEF DESCRIPTION OF THE DRAWING

The present invention will be described with reference to a preferred embodiment thereof in connection with the accompanying drawing, in which.

DESCRIPTION OF A PREFERRED EMBODIMENT OF THE INVENTION

Figure 1:
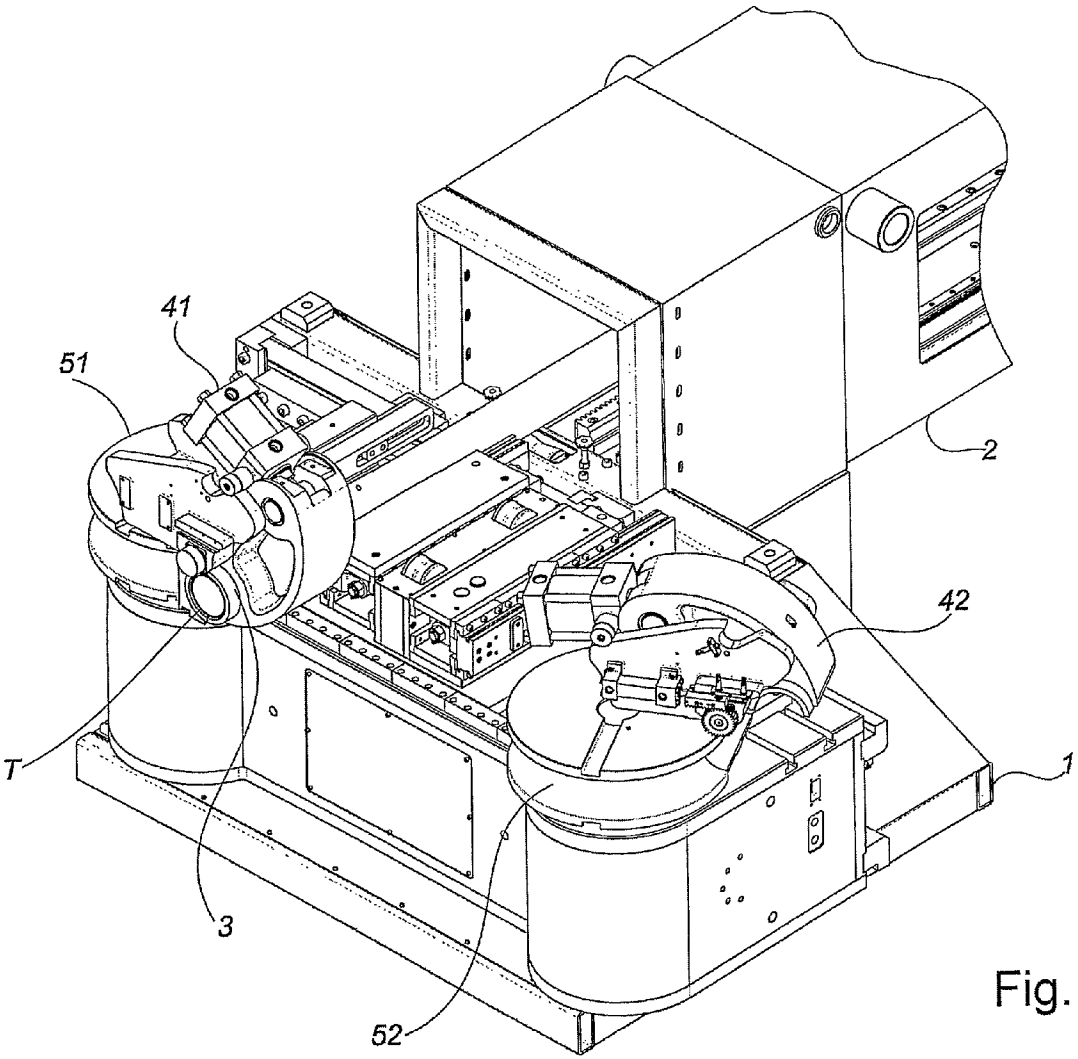
FIG. 1 shows in a fragmentary perspective view a dual headed bending machine with a pair of dies each being provided with a vise for clamping an elongated workpiece according to the present invention.

With reference to the drawings, FIG. 1 shows in a fragmentary perspective view a dual headed bending machine with a pair of dies each being provided with a vise for clamping an elongated workpiece according to the present invention.

In FIG. 1 a bed of the bending machine is indicated at 1 and a box-shaped structure at 2, the latter being disclosed in a previous patent application of the same Applicant. A pipe to be bent is designated at T whose portion 3 is surrounded by a vise 41 that is mounted on a die generally indicated at 51 in a first head of the dual headed bending machine. The first head vise 41 is depicted after the movable jaw has approached the pipe T and before clamping the same.

A vise and a die in a second head, that is not engaged at the moment in a bending operation are indicated at 42 and 52, respectively.

Other reference numeral relating to other bending machine parts that are useless for understanding the present invention are not indicated in FIG. 1. The invention is limited to a vise generally indicated at 4, which is described in detail below by an embodiment thereof with reference to FIGS. 2 to 8, where the vise is shown in perspective views (FIGS. 2 to 5) and in side elevation views (FIGS. 3, 4, 6, 7, and 8), respectively, in several operation positions. First, reference is made to FIGS. 2 to 4 that show the vise in an opened position.

Figure 3:
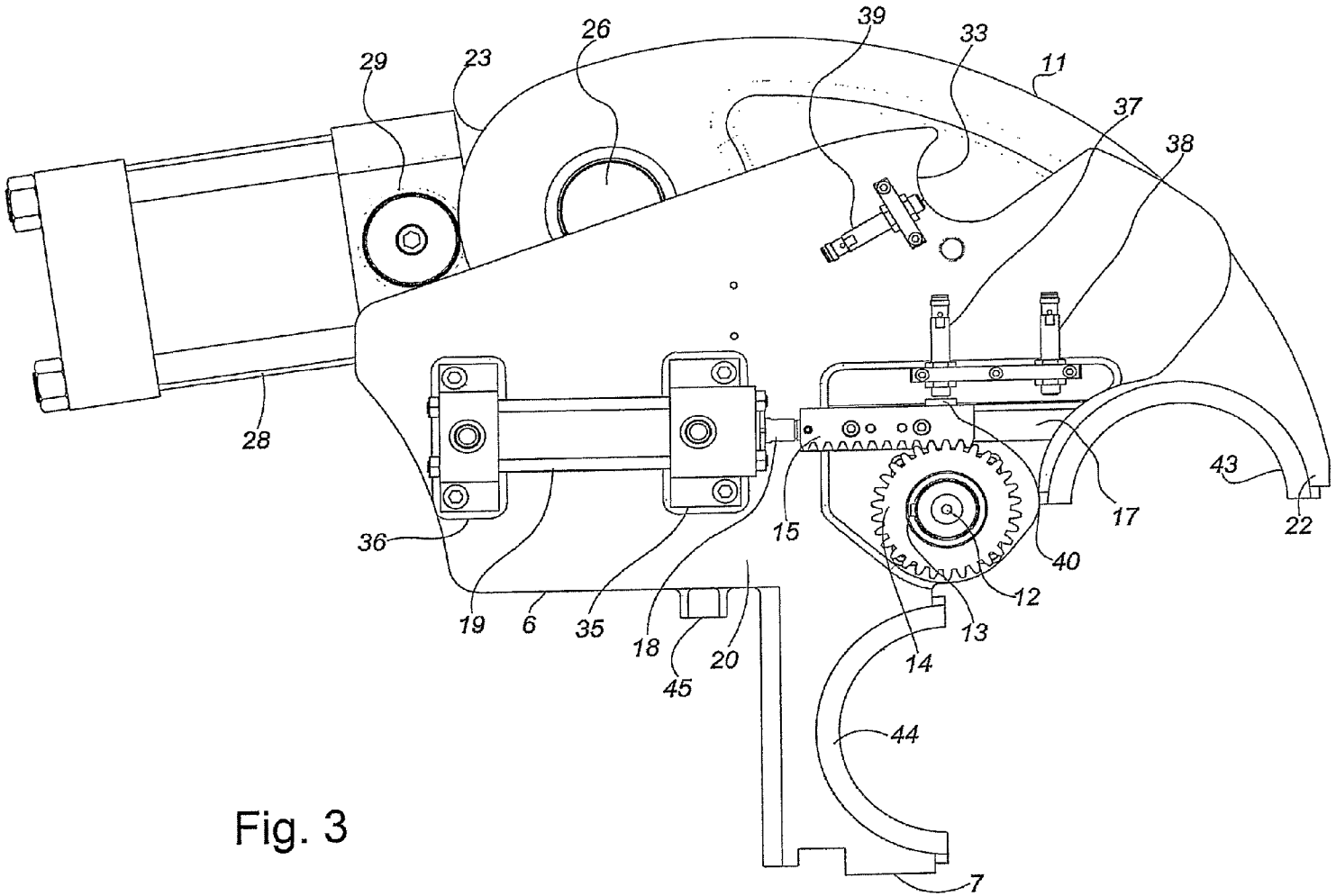
FIG. 3 shows in a side elevational view the vise in FIG. 2 in a side of an operation mechanism.

The vise 4 has a body 6 with a fixed jaw portion 7 projecting downward. Conventionally, the fixed jaw portion 7, being located adjacent a circumferential half-cylindrical concave groove of the die, acts as an insert integral with the die. In FIG. 3, an elongated projection designed to engage a corresponding hollow part of the die is indicated at 45. A half-cylindrical hollow part 44 is inserted in the fixed jaw portion to adapt the fixed jaw to the size of the elongated workpiece T to be bent.

Figure 2:
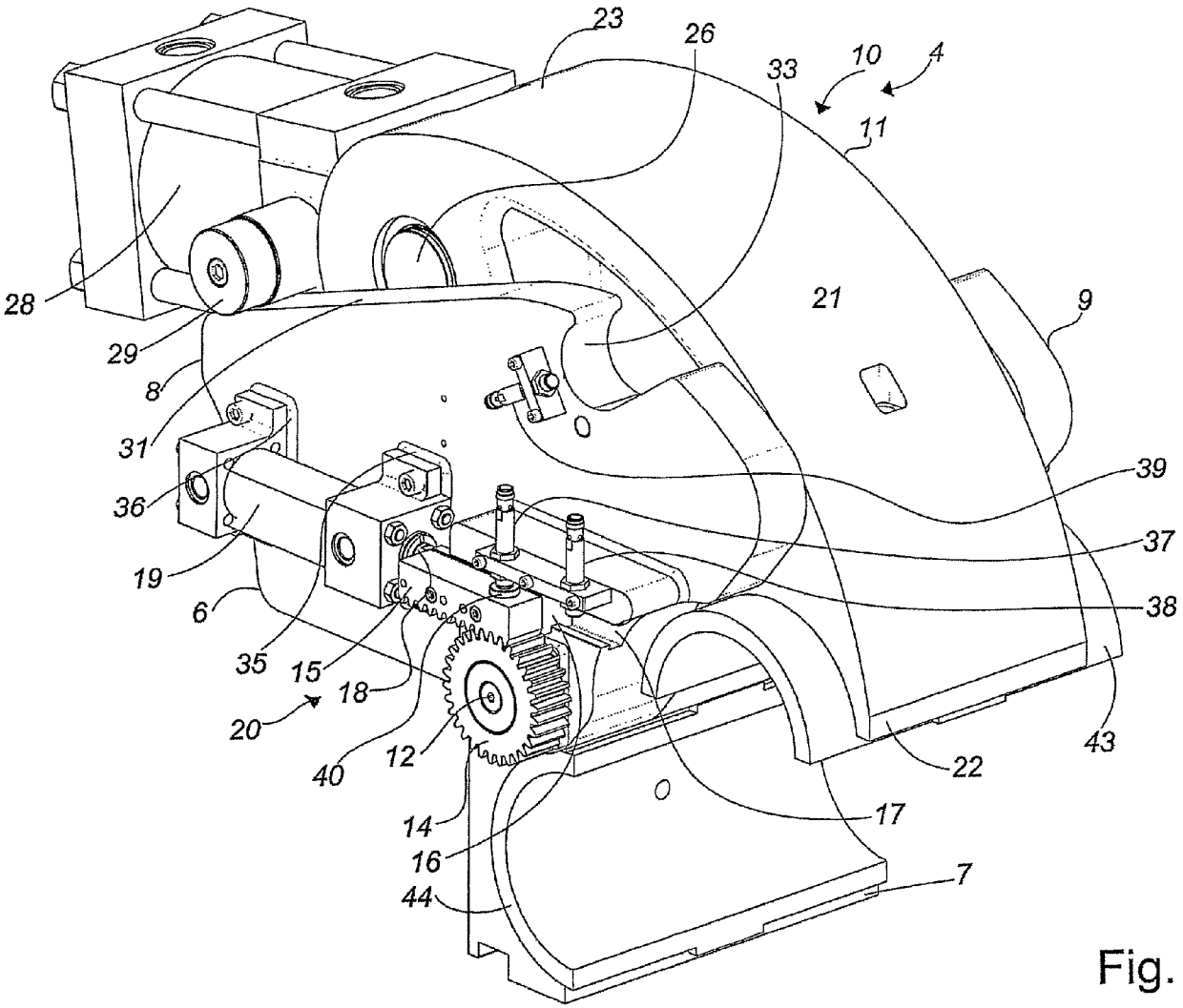
FIG. 2 shows in an enlarged perspective view the vise in FIG. 1 in its opened position.

According to the present invention the body 6 of the vise 4 laying on the top of the die as shown in FIG. 1, projects upward with two supporting walls 8, 9 that are generally parallel and co-operate with a movable jaw device 10 having a movable jaw 11. The movable jaw 11 is rotatably mounted being connected to a pivot 12 that is transversally arranged to the body 6 of the vise 4 in a position over the fixed jaw portion 7. The pivot 12 is keyed by a key 13 to a pinion 14, as shown in FIG. 3, where a covering washer as in FIG. 2 is not represented. The pinion 14 engages a rack member 15. The rack member 15 is laterally fastened to a slider 16 that is shaped to slide in a prismatic guide 17 projecting from the wall 8. The slider 16 is attached to a free end of the rod 18 of a first hydraulic cylinder 19 that is laterally fixed to the wall 8. Pinion 14, rack member 15, slider 16, guide 17 and hydraulic cylinder 19 with rod 18 form together an operation mechanism generally indicated at 20. For clarity sake neither hydraulic or electrical circuits are depicted in the figures.

In the operation mechanism 20 the rod 18 of the first hydraulic cylinder 19 has the slider 16 slidable along a cylinder axis in the prismatic guide 17 being connected to the external side of the supporting wall 8, and the rack member 15 that is laterally fixed to the slider 16, has a path parallel to the axis of the hydraulic cylinder 19.

The operation mechanism 20 serves to rotate the movable jaw device 10 in order to bring the movable jaw 11 near to the fixed jaw portion 7 and remove the one from the other. It should be evident that alternatively another operation mechanism, for example a worm screw, with an electric motor or other, could be used.

Figure 5:
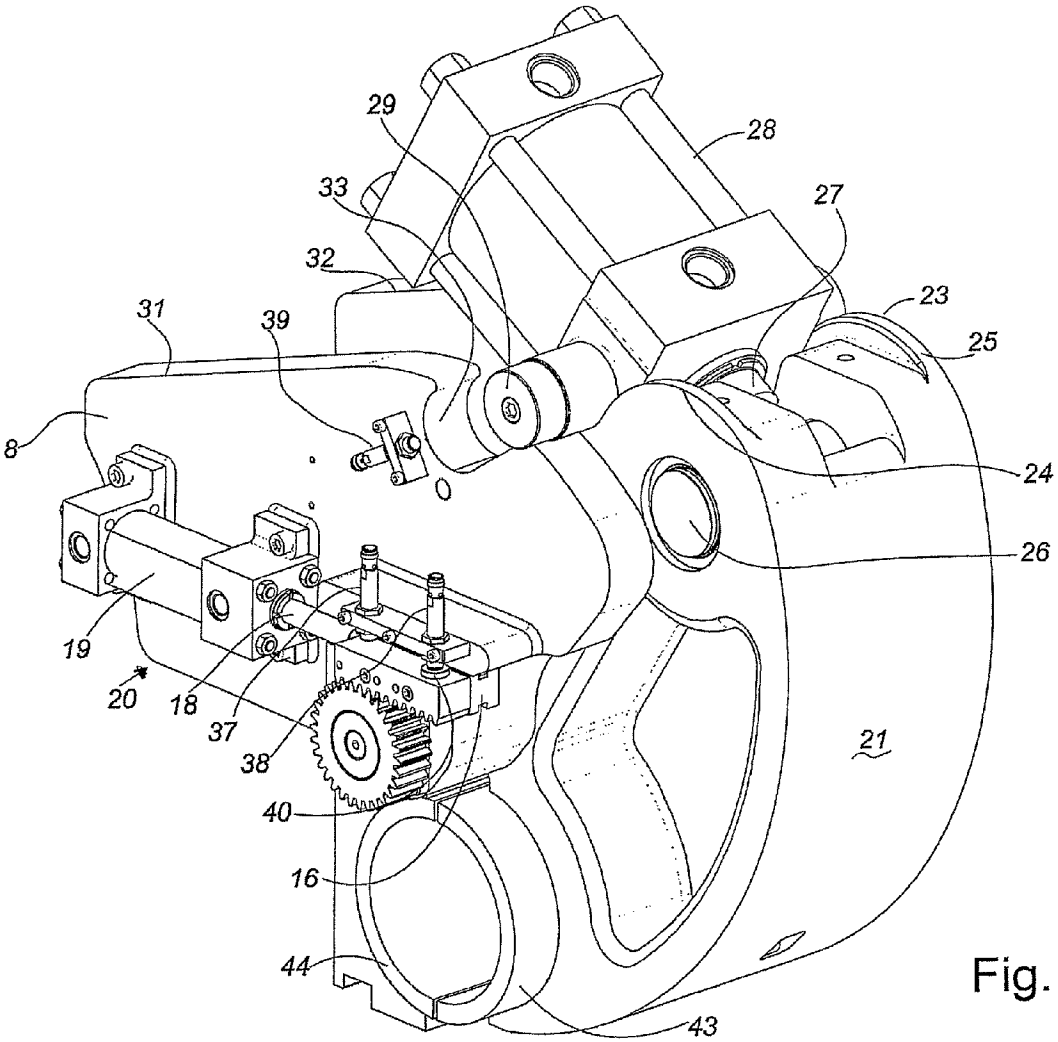
FIG. 5 shows in an enlarged perspective view the vise in FIG. 1 in its closed position.
Figure 8:
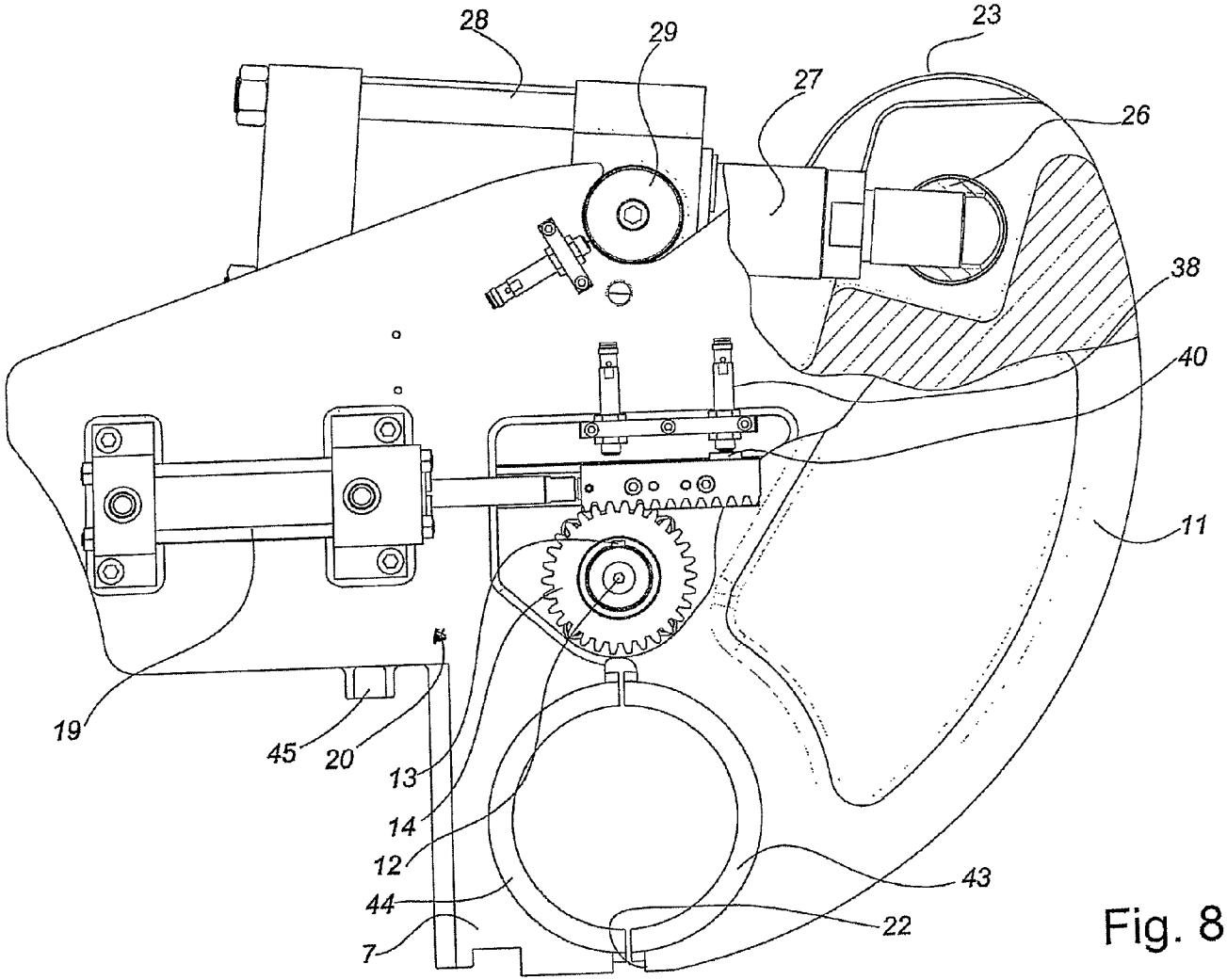
FIG. 8 shows in a partially cross-sectioned, side elevational view the vise according to the invention in its side carrying the operation mechanism, in a clamping position.

The movable jaw 11, which is provided with a partially elliptical external profile 21, has a front gripping end 22 having a concave half-cylindrical shape, which is of the same shape matching, in closed position, the half-cylindrical concave shape of the fixed jaw portion 7. A half-cylindrical hollow part 43 is inserted in the front gripping end 22, like that on the fixed jaw portion 7. The movable jaw has a convex centrally-lightened rear end 23 to obtain two rear side projections 24, 25 (FIG. 5). In these rear side projections 24, 25 a through hole is made transversally, inside which a small shaft 26 (as best seen in FIG. 8) is housed rotatably. The small shaft 26 has a T-connection with the rod 27 of a second hydraulic cylinder 28. Two preferably aligned spindles 29, 30, protrude transversally from the second hydraulic cylinder 28 and are designed to act as cam followers for the upper edges 31, 32, acting as cams, of the respective supporting walls 8, 9. Further sections of the rear side projections 24, 25 of the rear end 23 act as cams for the spindles 29, 30, in order to make the movement of the spindles 29, 30 more continuous.

The spindles 29, 30 are similar to trunnions, and the supporting walls 8, 9 form a mount on which the hydraulic cylinder 28 can slide. The upper edges 31, 32 of the supporting walls 8, 9 have two correspondent notches 33, 34 opened ahead.

Figure 4:
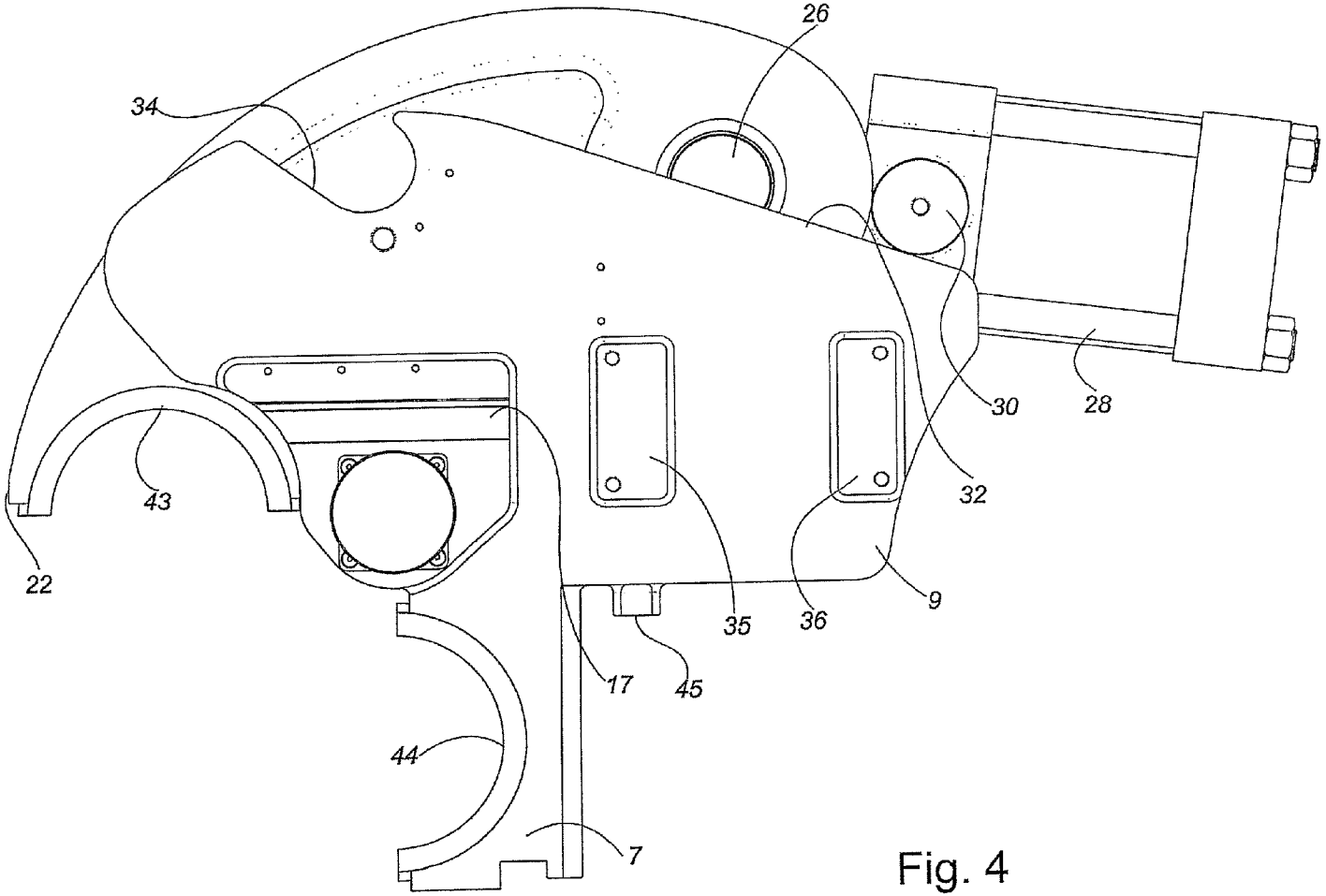
FIG. 4 shows in a side elevational view the vise in FIG. 2 in its side opposite to the side carrying the operation mechanism.

The spindle 30, the upper edge 32 and the notch 34 are shown in FIG. 4, which is a view of the vise 4 from the side opposite to that one on which the operation mechanism 20 is arranged. However, a guide 17 and bosses 35, 36 are provided also on the external side of the supporting wall 9 in case the operation mechanism 20 is located on the supporting wall 9.

Figure 6:
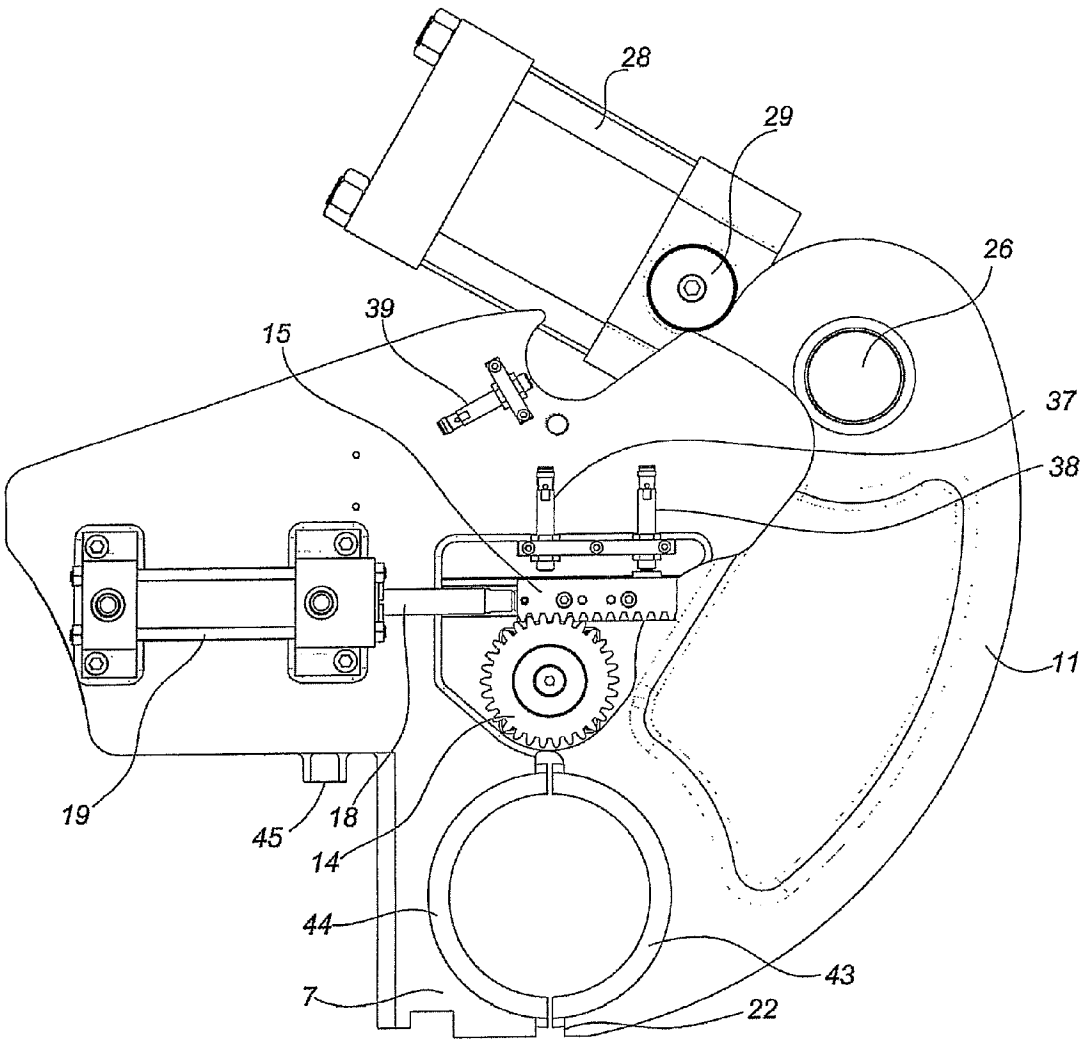
FIG. 6 shows in a side elevational view the vise in FIG. 5 in its side carrying the operation mechanism.
Figure 7:
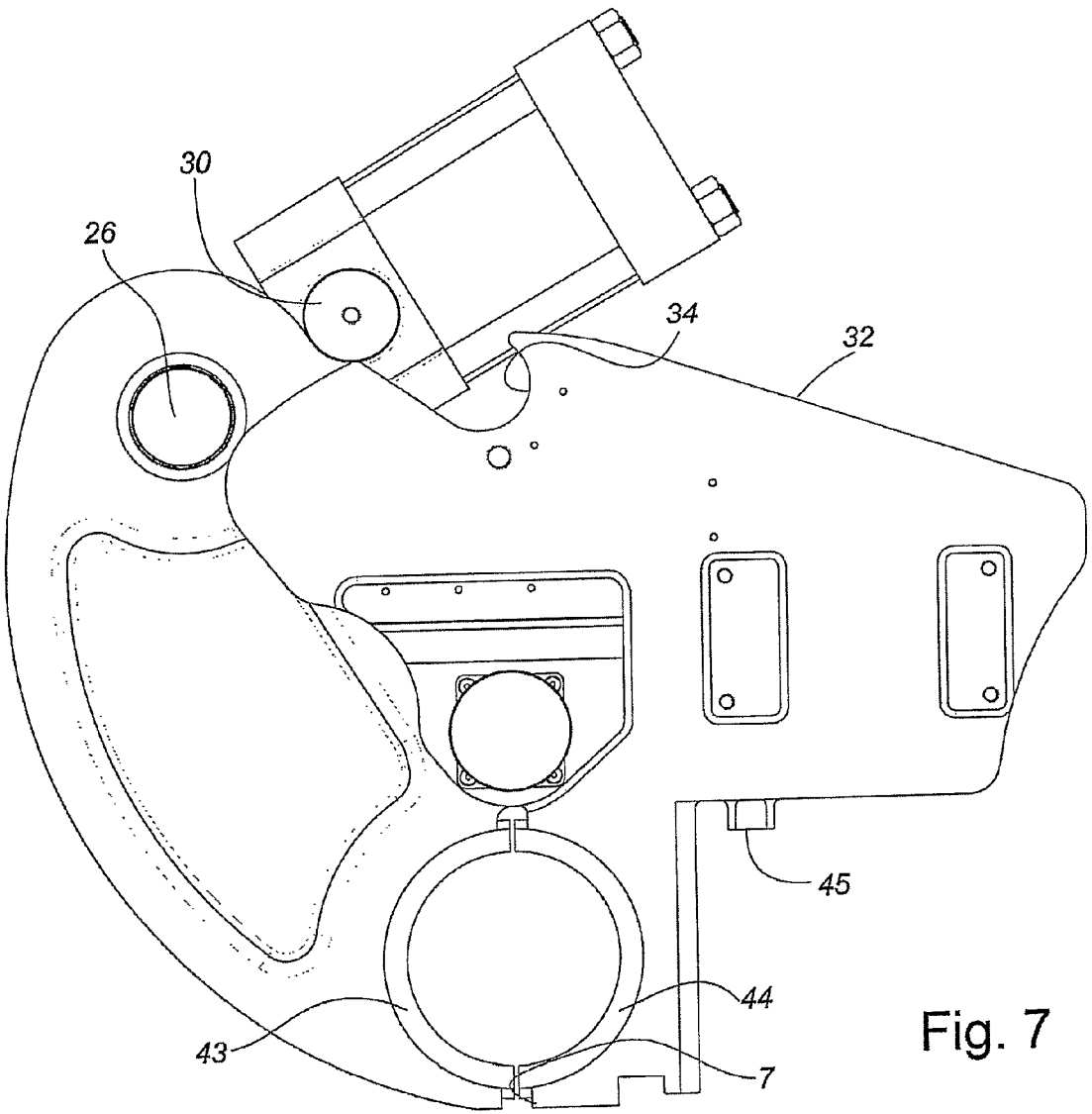
FIG. 7 shows in a side elevational view the vise in FIG. 5 in its side opposite to the side carrying the operation mechanism.

The small shaft 26 being T-connected with the rod 27 of the second hydraulic cylinder 28, the same second hydraulic cylinder 28, together with the upper edges 31, 32 of the supporting walls 8, 9 form a clamping mechanism, as it will be evident in the following description. Reference is made now to FIGS. 5 to 7, which show the vise in the closed but not clamped position. This is the position that the movable jaw 11 takes when the operation mechanism 20 rotates forward the movable jaw 11, together with the device 10, up to match the fixed jaw portion 7 and the front end 22 of the movable jaw 11, with the respective inserts 44, 43, for the adaptation to the diameter of the elongated workpiece. In this position, the second hydraulic cylinder is kept always near to the rear end 23 of the movable jaw, even if the trunnion spindles 29, 30 of the second hydraulic cylinder 28 have gone beyond the respective notches 33, 34, placing themselves on the crest of the supporting wall edge ahead of them.

As show in FIGS. 2, 3, 5, 6, and 8, proximity sensors, indicated at 37, 38, and 39 are provided to detect the position of the rack member 15 and of the trunnion spindles 29, 30.

In particular, when the vise 4 is in its opened position, the front end of the rack member sights with a projection 40 thereof the first proximity sensor 37, and when the vise 4 is in its closed position, the proximity sensor 38 is sighted.

It is clear that such a position of simple closure does not allow the vise to retain the elongated workpiece to be bent, as the operation mechanism of the movable jaw is not able to withstand the stresses occurring in a bending operation. For this purpose there are the notches 33, 34 designed to receive the trunnion spindles 29, 30 projecting from the second hydraulic cylinder.

Reference is made to FIG. 8, which shows in a side elevation view the clamped position of the vise. This position is achieved by extending the rod 27 of the second hydraulic cylinder 28 from the closed position of the movable jaw 11, as depicted in FIGS. 5 to 7. Since the second hydraulic cylinder 28 is free to swing together with the small shaft 26, the second hydraulic cylinder 28 displaces downward by its weight causing the trunnion spindles 29, 30 to fall into the respective notches 33, 34 of the supporting walls 8, 9. By further extending the rod 27, the second hydraulic cylinder 28 exercise a thrust on the rear end 23 of the movable jaw 11, which results in an effect counteracting the stresses of the elongated workpiece in the bending operation, stresses that would try to open the vise. In this way a very reliable clamping of the elongated workpiece is achieved. The position of the trunnion spindles 29, 30 inside the respective notches 33, 34 of the supporting walls 8, 9 is detected by the proximity sensor 39, sensor which gives its consent for pressuring a fluid inside the second hydraulic cylinder to counteract the opening of the vise 4. It should be clear that other detection systems can be adopted.

One of the main advantages of the present embodiment of the vise according to the invention is that its size is very reduced. This is above all due to the fact that the movable jaw is optimally shaped and the cylinder of the clamping mechanism has no permanent fixing point but only an anchoring in the notches when a counteracting force is requested.

Further, the vise is comprised of a reduced number of parts, so that it can be assembled easily and is cheap. Its operation is quick. The vise can be easily adapted, by virtue of the inserts of the jaws, for bending elongated workpieces with a wide diameter range. Furthermore, the vise is made symmetrically and can be assembled for dies bending both in a direction and in the opposite direction. The vise is mounted on the dies by means of normal screws or by male-female coupling.

In the preceding description an exemplifying but not limiting embodiment of the invention has been given which is defined in the enclosed claims.

The invention claimed is:

1. A vise provided with a movable jaw device having separated approaching and clamping steps in a bending machine die configured for bending an elongated workpiece (T), said vise (4) comprising:

a body (6) fixed on a die, the body (6) comprising i) two abreast supporting walls (8, 9), ii) a fixed jaw portion (7) projecting downward and located adjacent a groove of a die, the fixed jaw portion (7) being integral with the die, and iii) a movable jaw device (10) having a movable jaw (11), wherein the movable jaw (11) has a gripping end (22) and an opposite rear end (23), wherein the movable jaw (11) is approachable and removable with respect to the fixed jaw portion (7), wherein the movable jaw (11) moves between a closed position and an opened position with respect to the elongated workpiece (T);

a shaft (26) transversally mounted in the rear end (23) of the movable jaw (11);

an operation mechanism (20) mounted on an external side of one of said supporting walls (8) and connected to rotate the movable jaw device (10), wherein operation mechanism (20) comprises i) first hydraulic cylinder (19) having a first cylinder rod (18), a rack member (15) connected to the first cylinder rod (18), ii) a pinion (14) connected to the movable jaw (11) and engaging the rack member (15), and iii) a movable jaw clamping mechanism comprising a second hydraulic cylinder (28) having a second cylinder rod (27) connected with the shaft (26), the second hydraulic cylinder (28) being a) swing mounted by the second cylinder rod (27) being connected with the shaft (26), and b) transversally pivoted in the rear end (23) of the movable jaw (11);

opposite trunnion spindles (29, 30) laterally projecting from said second hydraulic cylinder (28) and arranged as cam followers on upper edges of the supporting walls (8, 9); and first and second notches (33, 34) located respectively in the upper edge (31, 32) of each of the supporting walls (8, 9), each of the first and second notches (33, 34) positioned to receive a corresponding one of the projecting trunnion spindles (29, 30) so that an extension of the second cylinder rod (27) is locked in position, by the projecting trunnion spindles (29, 30) being in the respective first and second notches (33, 34), to keep the movable jaw (11) in the closed position.

2. The vise according to claim 1, wherein said rear end (23) of the movable jaw (11) comprises rear side projections (24, 25) arranged as cams for said projection trunnion spindles (29, 30) of said second hydraulic cylinder (28).

3. The vise according to claim 1, further comprising:

a prismatic guide (17) integral with said external side of said one supporting wall (8); and a slider (16) fixed to a free end of the first cylinder rod (18) of the first hydraulic cylinder (19), the slider (16) slidable along an axis of the cylinder (19) in the prismatic guide (17), wherein said rack member (15) is fixed laterally to said slider (16) and has a path parallel to the axis of the cylinder (19).

4. The vise according to claim 1, further comprising:

at least a pair of proximity sensors (37, 38) arranged on said external side of said one supporting wall (8)

said at least a pair of proximity sensors (37, 38) sighting, on said path of the rack member (15), positions in said path corresponding to the opened position and the closed position respectively, of the movable jaw (11).

5. The vise according to claim 1, further comprising:

a proximity sensor (39) mounted on said external side of said one supporting wall (8) laterally with respect to said first notch (33), said proximity sensor (39) for detecting the corresponding projecting trunnion spindle (29) when said corresponding projection trunnion spindle (29) is in said first notch (33).

* * * * *

UNITED STATES PATENT AND TRADEMARK OFFICE

CERTIFICATE OF CORRECTION

PATENT NO. : 8,556,247 B2
APPLICATION NO. : 12/936216
DATED : October 15, 2013
INVENTOR(S) : Alessandro Caporusso It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 440 days.

Signed and Sealed this
Fifteenth Day of September, 2015

Michelle K. Lee

Michelle K. Lee
*Director of the United States Patent and Trademark Office*